US008950328B1

(12) United States Patent
Lang

(10) Patent No.: US 8,950,328 B1
(45) Date of Patent: Feb. 10, 2015

(54) METHODS OF FABRICATING ORGANIC ELECTRONIC DEVICES

(75) Inventor: Charles D. Lang, Goleta, CA (US)

(73) Assignee: E I du Pont de Nemours and Company, Wilmington, DE (US)

( * ) Notice: Subject to any disclaimer, the term of this patent is extended or adjusted under 35 U.S.C. 154(b) by 1970 days.

(21) Appl. No.: 11/312,857

(22) Filed: Dec. 20, 2005

Related U.S. Application Data

(60) Provisional application No. 60/640,807, filed on Dec. 29, 2004, provisional application No. 60/694,400, filed on Jun. 27, 2005.

(51) Int. Cl.
*B41M 1/00* (2006.01)

(52) U.S. Cl.
USPC ..... 101/491; 101/483

(58) Field of Classification Search
None
See application file for complete search history.

(56) References Cited

U.S. PATENT DOCUMENTS

| | | | | |
|---|---|---|---|---|
| 4,822,451 | A | 4/1989 | Ouderkirk et al. | 156/643 |
| 4,902,378 | A | 2/1990 | Ouderkirk et al. | 156/643 |
| 5,491,001 | A | 2/1996 | Mazaki et al. | 427/162 |
| 5,536,588 | A | 7/1996 | Naito | 428/690 |
| 5,578,382 | A | 11/1996 | Waddington | 428/480 |
| 5,916,979 | A | 6/1999 | Koegler et al. | 525/440 |
| 5,948,552 | A | 9/1999 | Antoniadis et al. | 428/690 |
| 6,033,278 | A * | 3/2000 | Watkins et al. | 445/41 |
| 6,077,563 | A | 6/2000 | Kapp et al. | 427/258 |
| 6,169,163 | B1 | 1/2001 | Woo et al. | 528/397 |
| 6,232,028 | B1 | 5/2001 | Landa et al. | 430/130 |
| 6,242,115 | B1 | 6/2001 | Thomson et al. | 428/690 |
| 6,303,238 | B1 | 10/2001 | Thompson et al. | 428/690 |
| 6,337,404 | B1 | 1/2002 | Han et al. | 548/440 |
| 6,361,886 | B2 | 3/2002 | Shi et al. | 428/690 |
| 6,517,957 | B1 | 2/2003 | Senoo et al. | 428/690 |
| 6,558,219 | B1 | 5/2003 | Burroughes et al. | 445/24 |
| 6,572,985 | B2 | 6/2003 | Xie | 428/690 |
| 6,670,645 | B2 | 12/2003 | Grushin et al. | 257/98 |
| 2001/0019782 | A1 | 9/2001 | Igarashi et al. | 428/690 |
| 2002/0063420 | A1 | 5/2002 | Nakashima et al. | 280/736 |
| 2003/0054197 | A1 | 3/2003 | Kwong | 428/690 |
| 2004/0048033 | A1 * | 3/2004 | Klausmann et al. | 428/68 |
| 2006/0238117 | A1 * | 10/2006 | Veres et al. | 313/506 |

FOREIGN PATENT DOCUMENTS

| | | | |
|---|---|---|---|
| EP | 1 191 612 | A2 | 3/2002 |
| EP | 1 191 614 | A2 | 3/2002 |
| WO | WO 00/70655 | | 11/2000 |
| WO | WO 01/41512 | A1 | 6/2001 |
| WO | WO 02/02714 | A2 | 1/2002 |
| WO | WO 02/15645 | A1 | 2/2002 |
| WO | WO 03/008424 | A1 | 1/2003 |
| WO | WO 03/040257 | A1 | 5/2003 |
| WO | WO 03/063555 | A1 | 7/2003 |
| WO | WO 03/091688 | A2 | 11/2003 |
| WO | WO 2004/016710 | A1 | 2/2004 |

OTHER PUBLICATIONS

Gustaffson, G. et al., "Flexible Light-Emitting Diodes made from Soluble Conducting Polymer", *Nature*, 1992, 357, 477-479.

(Continued)

*Primary Examiner* — Joshua D Zimmerman

(57) ABSTRACT

Methods for fabrication of organic electronic devices are described.

12 Claims, 1 Drawing Sheet

(56) References Cited

OTHER PUBLICATIONS

O'Brien, D.F. et al., "Electrophosphoresence from a Doped Polymer Light Emitting Diode", *Synthetic Metals*, 2001, 116(1-3), 379-383.

Campbell, I.H. et al., "Excitation Transfer Processes in a Phosphor-Doped Poly(*p*-phenylene vinylene) Light-Emitting Diode", *Physical Review B*., 65, 085210-1-085210-8.

Wang, Y., 4$^{th}$ Edition, 1996, 18, 837-860, *Kirk Othmer Encyclopedia of Chemical Technology*.

* cited by examiner

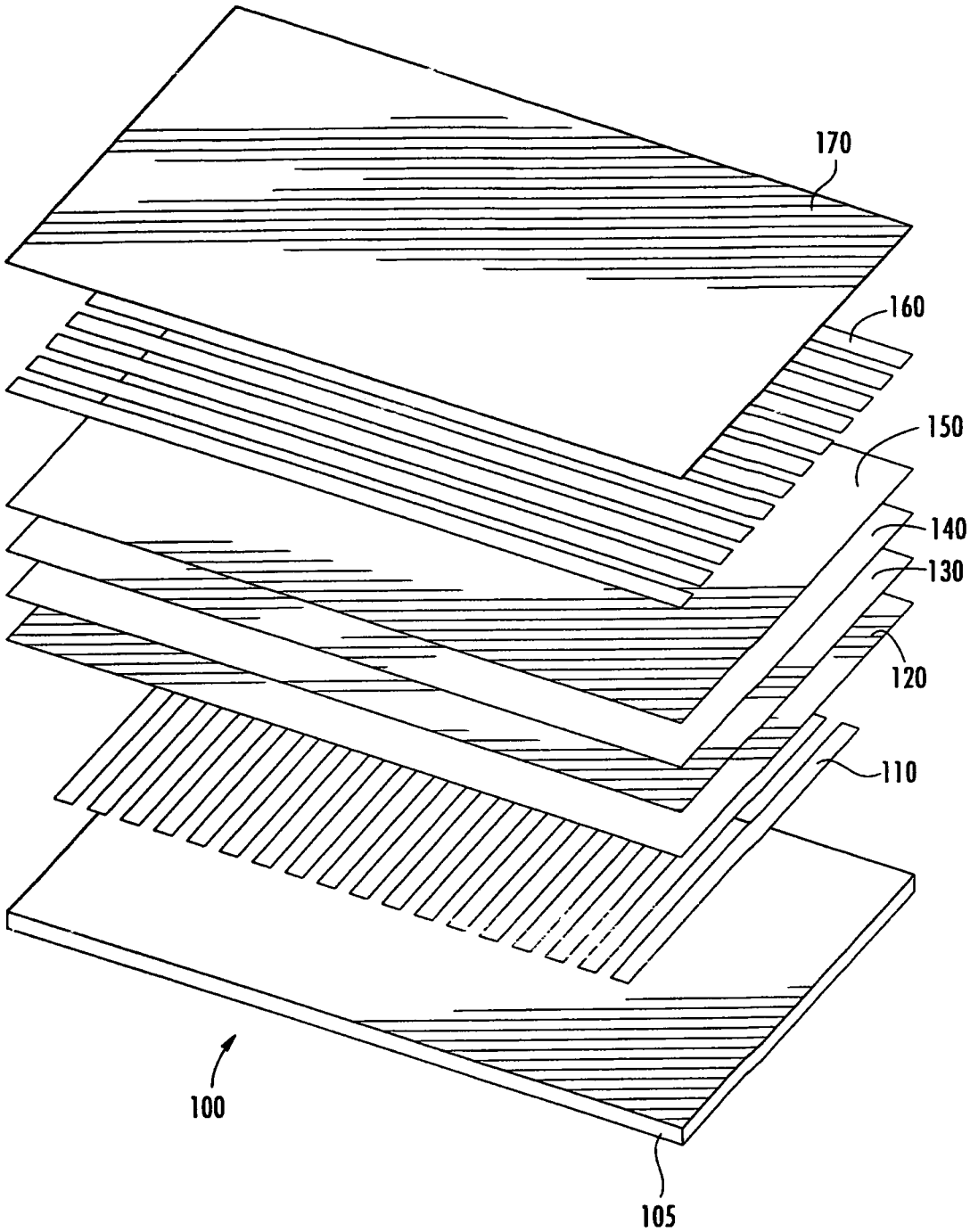
170
160
150
140
130
120
110
100
105

METHODS OF FABRICATING ORGANIC ELECTRONIC DEVICES

CROSS REFERENCE

This application claims benefit to U.S. Provisional Application Ser. Nos. 60/640,807, filed Dec. 29, 2004 and 60/694,400, filed Jun. 27, 2005, the disclosures of which are each incorporated herein by reference in their entireties.

FIELD

This disclosure relates generally to organic electronic devices, and materials and methods for fabrication of the same.

BACKGROUND

Organic electronic devices convert electrical energy into radiation, detect signals through electronic processes, convert radiation into electrical energy, or include one or more organic semiconductor layers. Most organic electronic devices are made up of a series of layers. To reduce costs, it is especially desirable to prepare these multilayer, patterned structures via additive processes, especially printing processes, to reduce material waste and process complexity. One such type of process is contact printing. These techniques have well-established equipment infrastructures and are commonly used in high-volume production. Contact printing also allows using high viscosity fluids so that surface tension effects are minimized, enabling precise material placement for good device resolution. However, previous methods of contact printing damaged the fragile polymer layers.

Thus, what is needed are methods of fabricating organic electronic devices.

SUMMARY

In one embodiment, methods of fabricating a device having multiple organic layers are provided, comprising providing a first organic layer, preventing the first organic layer from reaching its phase transition temperature, and contact printing a further layer on the first organic layer.

The foregoing general description and the following detailed description are exemplary and explanatory only and are not restrictive of the invention, as defined in the appended claims.

BRIEF DESCRIPTION OF THE DRAWINGS

Embodiments are illustrated in the accompanying figures to improve understanding of concepts as presented herein.

FIG. 1 is a schematic diagram of an organic electronic device.

The figures are provided by way of example and are not intended to limit the invention. Skilled artisans appreciate that objects in the figures are illustrated for simplicity and clarity and have not necessarily been drawn to scale. For example, the dimensions of some of the objects in the figures may be exaggerated relative to other objects to help to improve understanding of embodiments.

DETAILED DESCRIPTION

In one embodiment, methods of fabricating a device having multiple organic layers are provided, comprising providing a first organic layer, preventing the first organic layer from reaching its phase transition temperature, and contact printing a further layer on the first organic layer.

In one embodiment, the method further comprises preventing the first and second organic layers from reaching the lower of their phase transition temperatures, and contact printing a further layer on the second organic layer. In this determination of lowest of the phase transition temperatures, any phase transition temperature of a polymer layer or blended polymer layers is contemplated to include adjustments due to the affects of a fluid that swells or plasticizes the printed polymer layer or blended polymer layers, as described herein.

In one embodiment, the phase transition temperature is the average transition temperature of a blend of polymers, each having distinct phase transition temperatures.

In one embodiment, at least one of the organic layers is swollen by contact with a plasticizing solvent and the phase transition temperature of the swollen layer is determined according to the Hoy modification to the Fox-Flory equation. The Hoy modification to the Fox-Flory equation describes how a plasticizing fluid affects the Tg of a polymer:

$$1/Tg \sim Vp/Tgp + aVs/Tgs \quad [1]$$

where: Tg, Tgp and Tgs are, respectively, the glass transition temperatures of the mixture, polymer and solvent (plasticizer); Vp & Vs are, respectively, the volume fractions of polymer & solvent (plasticizer); and "a" is a correction factor. Since Tgs is typically much smaller than Tgp, one will strive to keep Vs small, and to keep Tgs and Tgp large. Various researchers have noted that the Tg of a thin film (~1000 Å) polymer coating on a substrate is often lower than the Tg measured as a bulk polymer property. This must be considered when setting up a process to reduce the temperature of the already coated layers. Dissimilar polymers can sometimes be blended by physical means, such as casting from an admixture in solution, or by allowing thin polymer layers to remain in contact in the presence of a compatibilizing solvent. Such mixtures will usually have a Tg intermediate to the bulk Tg's of the individual polymers.

In one embodiment, the phase transition temperature is a glass transition temperature.

In one embodiment, the contact printing comprises screen printing, flexographic printing, gravure printing, lithographic printing, rubber stamping, laminating, or decal transferring, or a combination thereof.

In one embodiment, at least one of the organic layers comprises a charge transport layer or a photoactive layer.

In one embodiment, at least one of the organic layers comprises a hole transport polymer selected from polyvinylcarbazole, (phenylmethyl)polysilane, poly(dioxythiophenes), polyanilines, or polypyrroles, or copolymers or mixtures thereof.

In one embodiment, at least one of the organic layers comprises an electron transport polymer selected from poly(oxadiazoles), polytriazoles, polypyridines, or polypyrimidines, or copolymers or mixtures thereof.

In one embodiment, at least one of the organic layers comprise polyethylene terephthalate ("PET"), polyethylene naphthalate, ("PEN"), polyimide, polycarbonate, polyamide, polyarylate, and polyethersulfone ("PES") films.

In one embodiment, the method further comprises contact printing a getter layer over the layers. The getter layer can be printed from a getter composition comprising for example particles of synthetic zeolite, natural zeolite or clay e.g., in an aqueous medium. In some examples, the getter composition comprises particles of natural or synthetic zeolite and powdered glass frit in an organic liquid medium that is substantially water-free. In addition, an encapsulation layer can be contact printed over the device. Any known encapsulating material can be used, including curable materials such as epoxy resins, novolac resins, polyimides, and the like.

In one embodiment, the method is performed iteratively.

Device

Referring to FIG. 1, an exemplary organic electronic device 100 is shown. The device 100 includes a substrate 105. The substrate 105 may be rigid or flexible, for example, glass, ceramic, metal, or plastic. When voltage is applied, emitted light is visible through the substrate 105.

A first electrical contact layer 110 is deposited on the substrate 105. For illustrative purposes, the layer 110 is an anode layer. Anode layers may be deposited as lines. The anode can be made of, for example, materials containing or comprising metal, mixed metals, alloy, metal oxides or mixed-metal oxide. The anode may comprise a conducting polymer, polymer blend or polymer mixtures. Suitable metals include the Group 11 metals, the metals in Groups 4, 5, and 6, and the Group 8, 10 transition metals. If the anode is to be light-transmitting, mixed-metal oxides of Groups 12, 13 and 14 metals, such as indium-tin-oxide, are generally used. The anode may also comprise an organic material, especially a conducting polymer such as polyaniline, including exemplary materials as described in *Flexible Light-Emitting Diodes Made From Soluble Conducting Polymer, Nature* 1992, 357, 477-479. At least one of the anode and cathode should be at least partially transparent to allow the generated light to be observed.

An optional buffer layer 120, such as hole transport materials, may be deposited over the anode layer 110, the latter being sometimes referred to as the "hole-injecting contact layer." Examples of hole transport materials suitable for use as the layer 120 have been summarized, for example, in Kirk Othmer, Encyclopedia of Chemical Technology, Vol. 18, 837-860 ($4^{th}$ ed. 1996). Both hole transporting "small" molecules as well as oligomers and polymers may be used. Hole transporting molecules include, but are not limited to: N,N' diphenyl-N,N'-bis(3-methylphenyl)-[1,1'-biphenyl]-4,4'-diamine (TPD), 1,1 bis[(di-4-tolylamino) phenyl]cyclohexane (TAPC), N,N' bis(4-methylphenyl)-N,N'-bis(4-ethylphenyl)-[1,1'-(3,3'-dimethyl)biphenyl]-4,4'-diamine (ETPD), tetrakis (3-methylphenyl)-N,N,N',N'-2,5-phenylenediamine (PDA), a-phenyl 4-N,N-diphenylaminostyrene (TPS), p(diethylamino)benzaldehyde diphenylhydrazone (DEH), triphenylamine (TPA), bis[4 (N,N-diethylamino)-2-methylphenyl](4-methylphenyl)methane (MPMP), 1 phenyl-3-[p-(diethylamino) styryl]-5-[p-(diethylamino)phenyl]pyrazoline (PPR or DEASP), 1,2 trans-bis(9H-carbazol-9-yl)cyclobutane (DCZB), N,N,N',N' tetrakis(4-methylphenyl)-(1,1'-biphenyl)-4,4'-diamine (TTB), and porphyrinic compounds, such as copper phthalocyanine. Useful hole transporting polymers include, but are not limited to, polyvinylcarbazole, (phenylmethyl)polysilane, and polyaniline. Conducting polymers are useful as a class. It is also possible to obtain hole transporting polymers by doping hole transporting moieties, such as those mentioned above, into polymers such as polystyrenes and polycarbonates.

An organic layer 130 may be deposited over the buffer layer 120 when present, or over the first electrical contact layer 110. In some embodiments, the organic layer 130 may be a number of discrete layers comprising a variety of components. Depending upon the application of the device, the organic layer 130 can be a light-emitting layer that is activated by an applied voltage (such as in a light-emitting diode or light-emitting electrochemical cell), or a layer of material that responds to radiant energy and generates a signal with or without an applied bias voltage (such as in a photodetector).

Other layers in the device can be made of any materials which are known to be useful in such layers upon consideration of the function to be served by such layers.

Any organic electroluminescent ("EL") material can be used as a photoactive material (e.g., in layer 130). Such materials include, but are not limited to, fluorescent dyes, small molecule organic fluorescent compounds, fluorescent and phosphorescent metal complexes, conjugated polymers, and mixtures thereof. Examples of fluorescent dyes include, but are not limited to, pyrene, perylene, rubrene, derivatives thereof, and mixtures thereof. Examples of metal complexes include, but are not limited to, metal chelated oxinoid compounds, such as tris(8-hydroxyquinolato)aluminum (Alq3); cyclometalated iridium and platinum electroluminescent compounds, such as complexes of Iridium with phenylpyridine, phenylquinoline, or phenylpyrimidine ligands as disclosed in Petrov et al., Published PCT Application WO 02/02714, and organometallic complexes described in, for example, published applications US 2001/0019782, EP 1191612, WO 02/15645, and EP 1191614; and mixtures thereof. Electroluminescent emissive layers comprising a charge carrying host material and a metal complex have been described by Thompson et al., in U.S. Pat. No. 6,303,238, and by Burrows and Thompson in published PCT applications WO 00/70655 and WO 01/41512. Examples of conjugated polymers include, but are not limited to poly(phenylenevinylenes), polyfluorenes, poly(spirobifluorenes), polythiophenes, poly(p-phenylenes), copolymers thereof, and mixtures thereof.

In one embodiment of the devices of the invention, photoactive material can be an organometallic complex. In another embodiment, the photoactive material is a cyclometalated complex of iridium or platinum. Other useful photoactive materials may be employed as well. Complexes of iridium with phenylpyridine, phenylquinoline, or phenylpyrimidine ligands have been disclosed as electroluminescent compounds in Petrov et al., Published PCT Application WO 02/02714. Other organometallic complexes have been described in, for example, published applications US 2001/0019782, EP 1191612; WO 02/15645, and EP 1191614. Electroluminescent devices with an active layer of polyvinyl carbazole (PVK) doped with metallic complexes of iridium have been described by Burrows and Thompson in published PCT applications WO 00/70655 and WO 01/41512. Electroluminescent emissive layers comprising a charge carrying host material and a phosphorescent platinum complex have been described by Thompson et al., in U.S. Pat. No. 6,303,238, Bradley et al., in *Synth. Met.* 2001, 116 (1-3), 379-383, and Campbell et al., in Phys. Rev. B, Vol. 65 085210.

A second electrical contact layer 160 is deposited on the organic layer 130. For illustrative purposes, the layer 160 is a cathode layer.

Cathode layers may be deposited as lines or as a film. The cathode can be any metal or nonmetal having a lower work function than the anode. Exemplary materials for the cathode can include alkali metals, especially lithium, the Group 2 (alkaline earth) metals, the Group 12 metals, including the rare earth elements and lanthanides, and the actinides. Materials such as aluminum, indium, calcium, barium, samarium and magnesium, as well as combinations, can be used. Lithium-containing and other compounds, such as LiF and $Li_2O$, may also be deposited between an organic layer and the cathode layer to lower the operating voltage of the system.

An electron transport layer 140 or electron injection layer 150 is optionally disposed adjacent to the cathode, the cathode being sometimes referred to as the "electron-injecting contact layer."

An encapsulation layer 170 is deposited over the contact layer 160 to prevent entry of undesirable components, such as water and oxygen, into the device 100. Such components can have a deleterious effect on the organic layer 130. In one embodiment, the encapsulation layer 170 is a barrier layer or film.

Though not depicted, it is understood that the device 100 may comprise additional layers. For example, there can be a layer (not shown) between the anode 110 and hole transport layer 120 to facilitate positive charge transport and/or band-gap matching of the layers, or to function as a protective layer. Other layers that are known in the art or otherwise may be used. In addition, any of the above-described layers may comprise two or more sub-layers or may form a laminar structure. Alternatively, some or all of anode layer 110 the hole transport layer 120, the electron transport layers 140 and 150, cathode layer 160, and other layers may be treated, especially surface treated, to increase charge carrier transport efficiency or other physical properties of the devices. The choice of materials for each of the component layers is preferably determined by balancing the goals of providing a device with high device efficiency with device operational lifetime considerations, fabrication time and complexity factors and other considerations appreciated by persons skilled in the art. It will be appreciated that determining optimal components, component configurations, and compositional identities would be routine to those of ordinary skill of in the art.

In one embodiment, the different layers have the following range of thicknesses: anode 110, 500-5000 Å, in one embodiment 1000-2000 Å; hole transport layer 120, 50-2000 Å, in one embodiment 200-1000 Å; photoactive layer 130, 10-2000 Å, in one embodiment 100-1000 Å; layers 140 and 150, 50-2000 Å, in one embodiment 100-1000 Å; cathode 160, 200-10000 Å, in one embodiment 300-5000 Å. The location of the electron-hole recombination zone in the device, and thus the emission spectrum of the device, can be affected by the relative thickness of each layer. Thus the thickness of the electron-transport layer should be chosen so that the electron-hole recombination zone is in the light-emitting layer. The desired ratio of layer thicknesses will depend on the exact nature of the materials used.

In operation, a voltage from an appropriate power supply (not depicted) is applied to the device 100. Current therefore passes across the layers of the device 100. Electrons enter the organic polymer layer, releasing photons. In some OLEDs, called active matrix OLED displays, individual deposits of photoactive organic films may be independently excited by the passage of current, leading to individual pixels of light emission. In some OLEDs, called passive matrix OLED displays, deposits of photoactive organic films may be excited by rows and columns of electrical contact layers.

Devices can be prepared employing a variety of techniques. These include, by way of non-limiting exemplification, vapor deposition techniques and liquid deposition. Devices may also be sub-assembled into separate articles of manufacture that can then be combined to form the device.

DEFINITIONS

As used herein, the term "phase transition temperature" is intended to mean the temperature at which a substantially solid, immobile substance loses that character. For example, in a crystalline material, the phase transition temperature is the melting point. Likewise, the temperature at which an amorphous material changes from a brittle, vitreous state to a plastic state is the glass transition temperature (Tg).

As used herein, the term "conductive polymer" refers to a polymer or oligomer which is inherently or intrinsically capable of electrical conductivity without the addition of carbon black or conductive metal particles. The term "polymer" encompasses homopolymers and copolymers. The term "conductive" includes both conductive and semi-conductive. In some embodiments, the electrically conductive polymer is conductive in a protonated form and not conductive in an unprotonated form. In one embodiment, the electrically conductive polymer will form a film which has a conductivity of at least 10-7 S/cm.

The term "buffer layer" as used herein, is intended to mean an electrically conductive or semiconductive layer which can be used between an anode and an active organic material. A buffer layer is believed to accomplish one or more function in an organic electronic device, including, but not limited to planarization of the underlying layer, hole transport, hole injection, scavenging of impurities, such as oxygen and metal ions, among other aspects to facilitate or to improve the performance of an organic electronic device. Although not wholly overlapping, the buffer layer generally refers to a charge transport layer.

The term "charge transport," when referring to a layer, material, member, or structure is intended to mean such layer, material, member, or structure facilitates migration of such charge through the thickness of such layer, material, member, or structure with relative efficiency and small loss of charge. "Hole transport layer" or "hole transport material" is a subset of charge transport layer or material, and such layer is capable of receiving a positive charge and transporting it. "Electron transport layer" or "electron transport material" is a subset of charge transport layer or material, and such layer is capable of receiving a negative charge and transporting it.

The terms "photoactive" refer to a material that emits light when activated by an applied voltage (such as in a light-emitting diode or light-emitting electrochemical cell), or responds to radiant energy and generates a signal with or without an applied bias voltage (such as in a photodetector). "Photoactive materials" may be polymers or small organic molecules and may be formulated as solutions, dispersions, suspensions, emulsions, colloidal mixtures, or other compositions. Photoactive materials include "emitter" or "luminescent material," which refer to a material that gives off light—emits light—when activated by an applied voltage (such as in a light-emitting diode or light-emitting electrochemical cell).

As used herein, the term "getter" means a substance that adsorbs contaminant gases that cause damage to organic layers in electronic devices. The getter materials may also absorb water. In one embodiment, the getter comprises a material selected from molecular sieves, clays, natural zeolites, and synthetic zeolites. A "getter layer" is formed from getter material.

The use of "a" or "an" are employed to describe elements and components of the invention. This is done merely for convenience and to give a general sense of the invention. This description should be read to include one or at least one and the singular also includes the plural unless it is obvious that it is meant otherwise.

The term "active" when referring to a layer or material is intended to mean a layer or material that exhibits electronic or electro-radiative properties. An active layer material may emit radiation or exhibit a change in concentration of electron-hole pairs when receiving radiation. Thus, the term "active material" refers to a material which electronically facilitates the operation of the device. Examples of active materials include, but are not limited to, materials which conduct, inject, transport, or block a charge, where the charge can be either an electron or a hole. Examples of inactive materials include, but are not limited to, planarization materials, insulating materials, and environmental barrier materials.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

The term "layer" is used interchangeably with the term "film" and refers to a coating covering a desired area. The area can be as large as an entire device or a specific functional area such as the actual visual display, or as small as a single sub-pixel. Films can be formed by any conventional deposition technique, including vapor deposition and liquid deposition. Liquid deposition techniques include, but are not limited to, continuous deposition techniques such as spin coating, gravure coating, curtain coating, dip coating, slot-die coating, spray-coating, and continuous nozzle coating; and discontinuous deposition techniques such as ink jet printing, gravure printing, and screen printing.

The term "organic electronic device" is intended to mean a device including one or more semiconductor layers or materials. Organic electronic devices include, but are not limited to: (1) devices that convert electrical energy into radiation (e.g., a light-emitting diode, light emitting diode display, diode laser, or lighting panel), (2) devices that detect signals through electronic processes (e.g., photodetectors photoconductive cells, photoresistors, photoswitches, phototransistors, phototubes, infrared ("IR") detectors, or biosensors), (3) devices that convert radiation into electrical energy (e.g., a photovoltaic device or solar cell), and (4) devices that include one or more electronic components that include one or more organic semiconductor layers (e.g., a transistor or diode). The term device also includes coating materials for memory storage devices, antistatic films, biosensors, electrochromic devices, solid electrolyte capacitors, energy storage devices such as a rechargeable battery, and electromagnetic shielding applications.

The term "substrate" is intended to mean a workpiece that can be either rigid or flexible and may include one or more layers of one or more materials, which can include, but are not limited to, glass, polymer, metal, or ceramic materials, or combinations thereof.

Unless otherwise defined, all technical and scientific terms used herein have the same meaning as commonly understood by one of ordinary skill in the art to which this invention belongs. Although methods and materials similar or equivalent to those described herein can be used in the practice or testing of embodiments of the present invention, suitable methods and materials are described below. All publications, patent applications, patents, and other references mentioned herein are incorporated by reference in their entirety, unless a particular passage is cited. In case of conflict, the present specification, including definitions, will control. In addition, the materials, methods, and examples are illustrative only and not intended to be limiting.

To the extent not described herein, many details regarding specific materials, processing acts, and circuits are conventional and may be found in textbooks and other sources within the organic light-emitting diode display, photodetector, photovoltaic, and semiconductive member arts.

EXAMPLES

The concepts described herein will be further described in the following examples, which do not limit the scope of the invention described in the claims.

Example 1

An organic light-emitting display is fabricated on a nominally 5 mils (125 microns) thick PEN substrate possessing a moisture and oxygen barrier, on which a 1200 Å ITO anode layer is patterned to provide alternating contacts.

A 2000 Å thick buffer layer of poly(ethylenedioxythiophene) ("PEDOT") is coated over the ITO layer using a contact printing method. The PEDOT is only printed in areas where light will emit from the display. The PEDOT solution is dried at 100-200° C. A solution of poly(p-phenylenevinylene) ("PPV") in toluene is coated, over the PEDOT layer using a contact printing technique to give a dry PPV layer having a thickness of <1000 Å. The PPV is also only printed in areas where light will emit from the display.

The PEDOT layer typically absorbs ca. 20% by volume toluene upon coating with the PPV solution; therefore the pre-coated substrate is cooled to a temperature calculated via equation [1], above, using the Tg's of PEDOT and toluene. The PPV solution is dried at 80-100° C. A cathode layer consisting of suspended silver particles is printed onto the PPV layer using a contact printing process. The suspension being formed of a solvent that does not swell PPV or PEDOT, and therefore does not change their Tg. During this printing step, the substrate is held at a temperature lower than the lesser of the Tg of PEDOT, the Tg of PPV adjusted for layer thickness, or the apparent Tg of the PEDOT+PPV stack.

The display is encapsulated by covering the display area (except for electrical contact leads) with epoxy and a lid.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

Many aspects and embodiments have been described above and are merely exemplary and not limiting. After reading this specification, skilled artisans appreciate that other aspects and embodiments are possible without departing from the scope of the invention.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

It is to be appreciated that certain features are, for clarity, described herein in the context of separate embodiments, may also be provided in combination in a single embodiment. Conversely, various features that are, for brevity, described in the context of a single embodiment, may also be provided separately or in any subcombination. Further, reference to values stated in ranges include each and every value within that range.

The invention claimed is:

1. A method of fabricating a device having multiple organic layers, comprising:

providing a first organic layer having a first phase transition temperature;

contact printing a second organic layer on the first organic layer wherein the first organic layer is maintained at a temperature below the first phase transition temperature during said contact printing; and contact printing a third layer on the second organic layer wherein the temperature of the first and second organic layers are maintained at a temperature below the lower of their phase transition temperatures during said contact printing of the third layer.

2. The method of claim 1, wherein the phase transition temperature is the average transition temperature of a blend of polymers, each having distinct phase transition temperatures.

3. The method of claim 1, wherein at least one of the organic layers is swollen by contact with a plasticizing solvent and the phase transition temperature of the swollen layer is determined according to the Hoy modification to the Fox-Flory equation.

4. The method of claim 1, wherein the phase transition temperature is a glass transition temperature.

5. The method of claim 1, wherein the contact printing comprises screen printing, flexographic printing, gravure printing, lithographic printing, rubber stamping, laminating, or decal transferring, or a combination thereof.

6. The method of claim 1, wherein at least one of the organic layers comprises a charge transport layer or a photoactive layer.

7. The method of claim 1, wherein at least one of the organic layers comprises a hole transport polymer selected from polyvinylcarbazole, (phenylmethyl)polysilane, poly (dioxythiophenes), polyanilines, or polypyrroles, or copolymers or mixtures thereof.

8. The method of claim 1, wherein at least one of the organic layers comprises an electron transport polymer selected from poly(oxadiazoles), polytriazoles, polypyridines, or polypyrimidines, or copolymers or mixtures thereof.

9. The method of claim 1, wherein at least one of the organic layers comprises polyethylene terephthalate, polyethylene naphthalate, polyimide, polycarbonate, polyamide, polyarylate, and polyethersulfone films.

10. The method of claim 1, wherein the method further comprises contact printing a getter material over the layers.

11. The method of claim 1, wherein the first organic layer is applied by contact printing.

12. The method of claim 11, wherein the first and second organic layers are only printed where light will emit from said device.

* * * * *